US007108477B2

(12) United States Patent
Grauer

(10) Patent No.: US 7,108,477 B2
(45) Date of Patent: Sep. 19, 2006

(54) WARNING BEFORE PUMP LIMIT OR IN CASE OF BLADE FAILURE ON A TURBOMACHINE

(75) Inventor: Frank Grauer, Karlsfield (DE)

(73) Assignee: MTU Aero Engines GmbH, Munich (DE)

( * ) Notice: Subject to any disclaimer, the term of this patent is extended or adjusted under 35 U.S.C. 154(b) by 151 days.

(21) Appl. No.: 10/493,426

(22) PCT Filed: Sep. 7, 2002

(86) PCT No.: PCT/DE02/03325

§ 371 (c)(1),
(2), (4) Date: Sep. 24, 2004

(87) PCT Pub. No.: WO03/038282

PCT Pub. Date: May 8, 2003

(65) Prior Publication Data

US 2005/0038570 A1 Feb. 17, 2005

(30) Foreign Application Priority Data

Oct. 23, 2001 (DE) ..... 101 52 026

(51) Int. Cl.
*F01D 25/00* (2006.01)
*F01D 17/08* (2006.01)

(52) U.S. Cl. ..... 415/1; 415/17; 415/47; 415/118

(58) Field of Classification Search ..... 415/1, 415/17, 47, 118; 702/138, 182
See application file for complete search history.

(56) References Cited

U.S. PATENT DOCUMENTS 5,275,528 A 1/1994 Freeman et al.
5,767,780 A 6/1998 Castleberry et al.
5,915,917 A * 6/1999 Nett et al. ..... 415/1
6,231,306 B1 5/2001 Khalid
6,506,010 B1 * 1/2003 Yeung et al. ..... 415/1

OTHER PUBLICATIONS

He, Computational Study of Rotating-Stall Inception in Axial Compressors, Journal of Propulsion and Power, vol. 13, No. 1, Jan.-Feb. 1997, pp. 31-38.

* cited by examiner

*Primary Examiner*—Ninh H. Nguyen
(74) *Attorney, Agent, or Firm*—Crowell & Moring LLP

(57) ABSTRACT

In a method for determination of a surge limit warning (W) for a turbocompressor, or a warning of blade damage, at least two measurement signals ($p_1$, $p_2$; $\tilde{p}_1$, $\tilde{p}_2$), are determined, a periodicity value ($W_1$; $\tilde{W}_1$) is calculated from at least one of the measurement signals ($p_1$, $p_2$; $\tilde{p}_1$, $\tilde{p}_2$), indicating a measure for the occurrence of periodic signal level changes in the at least one measurement signal ($p_1$, $p_2$; $\tilde{p}_1$, $\tilde{p}_2$) for a predetermined first time offset ($t_1$), a correlation value ($W_2$; $\tilde{W}_2$) is calculated from the at least two measurement signals ($p_1$, $p_2$; $\tilde{p}_1$, $\tilde{p}_2$), indicating a measure for the similarity of the at least two measurement signals ($p_1$, $p_2$; $\tilde{p}_1$, $\tilde{p}_2$) to one another for a predetermined second time offset ($t_2$), and the surge limit warning (W) or the warning of blade damage (W) is determined from the periodicity value ($W_1$; $\tilde{W}_1$) and the correlation value ($W_2$; $\tilde{W}_2$). A method for operation of a gas turbine or of a turbomachine as well as a turbocompressor and a gas turbine have corresponding features.

20 Claims, 3 Drawing Sheets

WARNING BEFORE PUMP LIMIT OR IN CASE OF BLADE FAILURE ON A TURBOMACHINE

BACKGROUND AND SUMMARY OF THE INVENTION

The invention relates in general to the field of turbocompressors, such as are used in gas turbines (in particular as aircraft engines), for energy generation or in the chemical industry. In particular the invention is directed to a method and apparatus for timely identifying an incipient compressor surge during operation of a turbocompressor so that suitable countermeasures can be taken. The invention also relates to blade damage to a rotor of a turbomachine, such as a steam turbine or gas turbine. The gas turbine may be an aircraft engine or a stationary gas turbine, which have rotors in both the compressor and the turbine.

Turbocompressors generally have a stability limit which is dependent on their power characteristic. If this stability limit is inadvertently exceeded during operation of the turbocompressor (for example as a result of inlet disturbance, temperature changes or dirt), then severe non-stationary disturbances occur (rotating separation, surging), which can rapidly lead to destruction of the machine. When designing the turbocompressor, it is therefore normal to provide a sufficient margin between the operating line and the stability limit, with all disturbances which could reduce the surge limit margin being taken into account as the safety margin. However, a fixed safety margin such as this results in a considerable loss of operating range for the compressor with good efficiency.

In order to further improve the efficiency and/or the power density in modern designs, investigations have been carried out to determine how turbocompressors can be operated safely close to the stability limit. When an incipient surge occurs (when a predetermined minimum surge limit margin is infringed), it is known that the operating line of the compressor can fall rapidly, or the surge limit can be shifted. This may occur, for example, as a result of a blow-off valve being opened and/or as a result of adjustment of guide vanes, and/or as a result of a reduction in the fuel supply. Various approaches have been adopted in order to determine that the surge limit is being approached.

German Patent Document DE 693 25 375 T2 discloses a method for monitoring and controlling a compressor, in which pressure fluctuations within a compressor stage are measured, and their frequency components are analyzed. If at least one characteristic spike occurs in a frequency range which is dependent on the rotation speed and the number of blades, a warning signal is produced as a function of the shape of the at least one spike which has occurred. The warning signal may be used for closed-loop and open-loop control purposes, in order to avoid the incipient critical state by, for example, reducing the load or reducing the fuel injection rate.

U.S. Pat. No. 6,231,306 B1 discloses a control system for preventing flow separation in a turbocompressor. A mean value for the square of the amplitude of a relevant frequency range is calculated from a measurement signal that is determined by a pressure sensor. The mean value is normalized and compared with a threshold value. If the threshold value has been exceeded, either a blow-off valve is opened or the guide vane position is changed.

German Patent Document DE 694 11 950 T2 discloses a method for identification of a surging, in which the engine exhaust gas temperature and the engine compressor rotation speed are evaluated.

There is a need to further improve the known methods in terms of their reliability and/or the complexity required for sensor systems and signal processing.

One object of the invention is accordingly to provide a method for reliably identifying an incipient surging in a turbocompressor in good time, such that suitable measures can still be taken in order to avoid surging.

A further object of the invention aim is to identify blade damage to a rotor of a turbomachine as early as possible.

Another object of the preferred embodiments of the invention is to achieve this aim with as few additional sensors as possible, that is to say with as few sensors as possible which are not already provided in any case for the turbocompressor. Finally, still a further object of the preferred embodiments of the invention is to avoid complex computation operations, in order to achieve a rapid reaction rate (data processing in real time) with relatively little computation power.

According to the invention, these objects are achieved by a method for determination of a warning, by a method for operation of a gas turbine or of a turbomachine, by a turbocompressor and by a gas turbine as described herein.

The invention is based on the fundamental idea of identifying revolving disturbances which occur as the compressor stability limit is approached. In experiments in which the compressor was slowly choked as far as the surge limit, revolving disturbances such as these could be observed as a primary factor in the compressor instability. The speed of revolution in the annular space of the compressor is dependent on the compressor and, in some circumstances, also on the rotation speed. The disturbances may be both long-wave (modal) and short-wave (in the form of so-called spikes).

According to the invention, a combined criterion is provided for the warning. This criterion is composed firstly of a secondary criterion that the characteristic, periodic disturbance patterns occur considerably in the measurement signal of a temperature, pressure or flow velocity sensor, and secondly from the secondary criterion that the measurement signal from the first sensor is correlated with the measurement signal from a second sensor, which is arranged offset with respect to the first sensor in the circumferential direction of the turbocompressor or of the turbomachine. Further temperature, pressure or flow velocity sensors may be provided. The warning is produced as a function of the extent to which these two secondary criteria are satisfied.

The invention provides reliable early identification of surging and blade damage based on the identification of the stated characteristic signal structures, which occur when the operating point approaches the surge limit and in the event of blade damage. The instrumental complexity is low because the at least two sensors which are required are either already present for other reasons in normal compressors, or they can at least be added without difficulties. The computation complexity for determination of the two secondary criteria mentioned above is not particularly great either, in particular because no complex frequency analyses are required. The invention allows a rapid-response surge limit warning or a warning of blade damage to be emitted with relatively little computation power.

In the wording used in the present document, the expression "surging" should be regarded in the widest sense and, in addition to actual surging, also covers rotating flow separation (rotating stalling) in the compressor. The expression "surge limit warning" should accordingly be regarded as any warning signal providing information about incipient flow separation or surging in the compressor.

The at least two temperature, pressure or flow velocity sensors provided according to the invention are arranged offset with respect to one another in the circumferential direction of the turbocompressor or of the turbomachine. They may have a circumferential separation of 180° or else less, for example 90°, 60°, 45° or 30°. Even if more than two temperature, pressure or flow velocity sensors are provided, they do not necessarily need to be arranged with a standard circumferential separation. The at least two sensors are preferably located on a common axial plane of the turbocompressor or of the turbomachine. This may, for example, be the plane in front of the first rotor; however, other planes are likewise possible.

The at least two measurement signals determined according to the invention correspond to the output signals from in each case one of the temperature, pressure or flow velocity sensors. The expression "correspond" does not necessarily mean that they are identical; in fact, the output signal from a sensor may, for example, be scaled (multiplied by a constant or a variable factor) or shifted (added to a constant or variable value, for example in order to remove the mean value) or inverted (multiplied by −1 or formation of the reciprocal), in order to obtain the appropriate measurement signal from it. Furthermore, the measurement signals are preferably digital value sequences, which have been obtained by analog/digital conversion (and possibly further processing steps) from the analog sensor output signals.

According to the invention, a first time offset and a second time offset, respectively, are used for determination of the periodicity value and of the correlation value. In different embodiments of the invention, the first and/or the second time offset are constant (possibly as a function of the compressor type) or are dependent on the respective speed of revolution or other parameters (for example the compressor pressure). The invention is also not restricted to calculation of in each case only one periodicity value and correlation value; in fact, embodiments are also envisaged in which two or more of these values are always calculated and evaluated (typically with different time-offset values or for different measurement signals).

The steps in the method according to the invention are preferably carried out by a programmable device, for example a digital signal processor (DSP). However, implementations are also feasible with hard-wired digital logic or analog implementations. The sequence in which the method steps are enumerated in the claims should not be regarded as any restriction; in fact, these method steps may also be carried out in a different sequence, or entirely or partially in parallel or semi-parallel (interleaved with one another).

In preferred embodiments, the warning is emitted when the product of the periodicity value and of the correlation value exceeds a predetermined threshold value. In other embodiments, rather than forming the product, a different function is used which links the two stated values such that large periodic signal changes and/or a high signal correlation lead to the warning being emitted. The threshold value calculation can in further embodiments be carried out independently for the two values, with the warning preferably being emitted only when both threshold values are exceeded.

In order to calculate the periodicity value and/or the correlation value, the required measurement signals are preferably evaluated using a sliding window with a predetermined (fixed or dependent on the measurement values) window width. The window width governs the required computation complexity and can therefore also be varied depending on the available computation power. The sampling frequency for the sensors and for signal evaluation is in the order of magnitude of 1 kHz to 2 kHz in preferred refinements.

Provision is preferably made for the periodicity value to be calculated as the average value (scaled or not scaled) of the square error between in each case two measurement points, which are shifted by the first time offset with respect to one another, of one of the measurement signals. The evaluated measurement signal is in some embodiments previously subjected to removal of the mean value. In alternative embodiments, the magnitude difference or the cube of the magnitude difference is formed instead of the square error. A pure addition formation process may also be carried out, instead of calculation of the mean value, in alternative embodiments (particularly when the window width and/or the first time offset are/is constant). Overall, the periodicity value is intended to indicate the extent to which structures with strong periodic signal changes occur in the measurement signal.

In order to calculate the correlation value, the mean value of the product of in each case two measurement points, which are offset by the second time offset with respect to one another, of two different measurement signals is calculated in preferred embodiments. In this case as well, an addition process may be carried out in alternative embodiments rather than formation of the mean value, and a different function may be used rather than the product calculation. Overall, the correlation value is intended to indicate how accurately the two measurement signals under consideration match when they are shifted through the second time offset with respect to one another.

In some embodiments of the invention, the warning that is determined is just indicated to a pilot or to some other operator. Preferably, however, an operating parameter of the turbocompressor is changed in reaction to the surge limit warning in a method step which takes place automatically, in order to avoid a compressor surge. For example, a blow-off valve may be opened, or the stator blades of the turbocompressor may be adjusted.

If the turbocompressor is a component of a gas turbine, then the flow can also be stabilized when proximity to the surge limit is identified by thrust nozzle adjustment, blowing in or out, variable guide vane adjustment or fuel modulation, before the compressor becomes aerodynamically unstable.

The stated measures mean that it is possible to operate the gas turbine (for example the aircraft engine) closer to the surge limit in many operating conditions than would be possible with a static surge limit margin. This leads to improved efficiency and to improved fuel consumption characteristics (lower thrust-specific fuel consumption SFC). Even if this option is not exhausted, the operational reliability of the gas turbine is improved because disturbances which would lead to instability without regulation are identified in advance, and are overcome by increasing the surge limit margin in a controlled manner.

When a gas turbine (in particular an aircraft engine) is being newly developed using the invention, the improvements which can be achieved by the invention may be taken into account in order to design the new development for a higher turbine stage load, if required, and/or to optimize the required surge limit margin as a function of the requirement.

In preferred refinements, the turbomachine, the turbocompressor and the gas turbine are developed with features which correspond to the features described above or to the features mentioned in the dependent method claims.

BRIEF DESCRIPTION OF THE DRAWINGS

Further features, advantages and objects of the invention will become evident from the following detailed description of an exemplary embodiment and from a number of alternative embodiments. Reference should be made to the schematic drawings, in which.

DETAILED DESCRIPTION OF THE DRAWINGS

Figure 1:
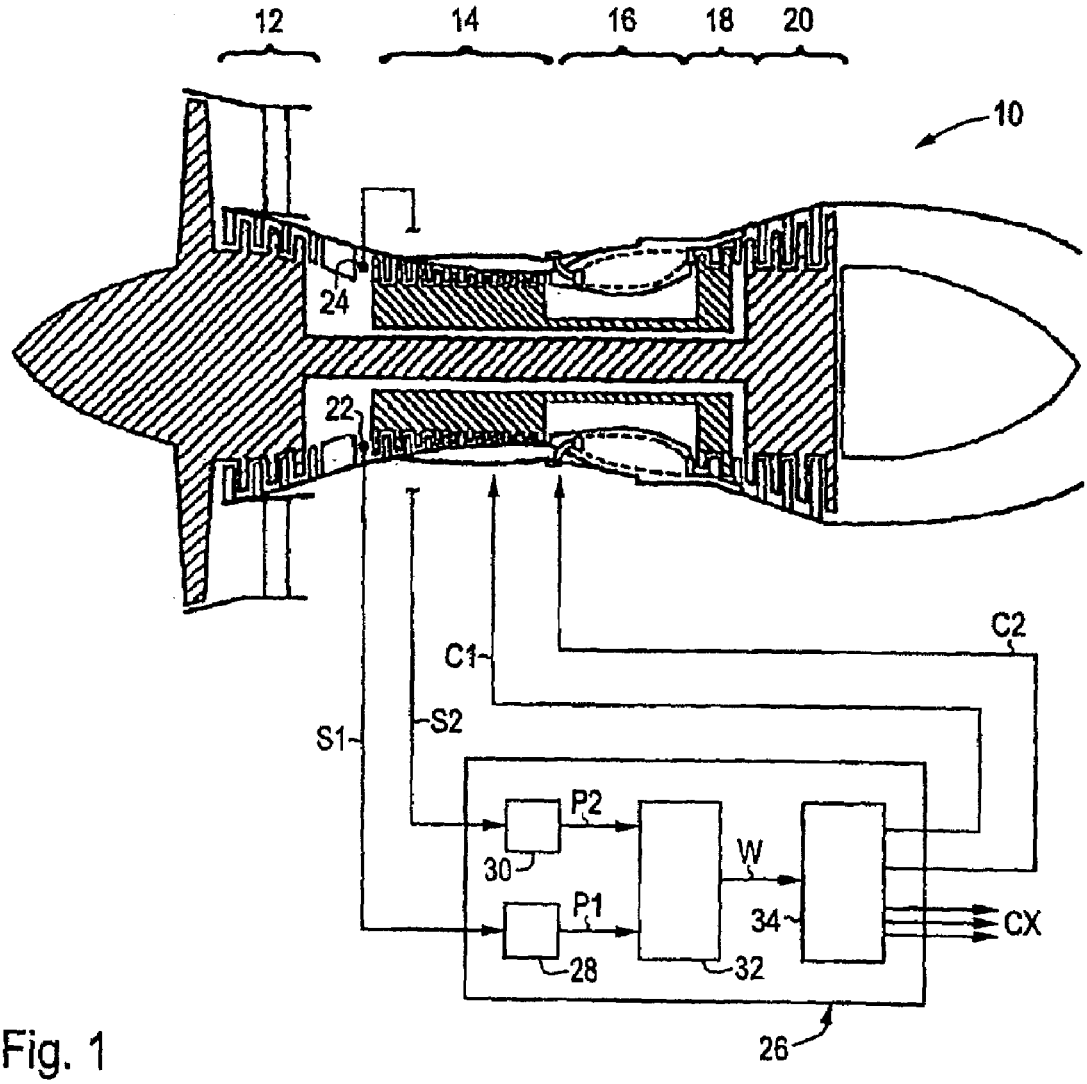
FIG. 1 shows a schematic section view through a gas turbine which is in the form of an aircraft engine and has a control unit connected to it.

The two-spool gas turbine 10 illustrated in FIG. 1 is known per se and has a multistage low-pressure compressor 12 and a multistage high-pressure compressor 14. These are followed in the flow direction by a combustion chamber 16, a high-pressure turbine 18 and a low-pressure turbine 20. The low-pressure compressor 12 and the low-pressure turbine 20 are connected by a common (inner) shaft, and the high-pressure compressor 14 and the high-pressure turbine 18 are likewise connected by a common (outer) shaft.

In the present exemplary embodiment, the gas turbine 10 is in the form of an aircraft turbine. In alternative embodiments, the invention may also be used for single-spool gas turbines, for gas turbines with three or more shafts, for stationary gas turbines (for example in power stations) and for compressors for other purposes (for example process technology, ventilation).

Two sensors 22, 24 are arranged on a common axial plane in the flow direction upstream of the first rotor of the high-pressure compressor 14. The sensors 22, 24 are offset with respect to one another in the circumferential direction, to be precise in the present exemplary embodiment through 180°. In the exemplary embodiment described here, the sensors 22, 24 are piezoelectric pressure sensors, which are known per se. Flow velocity sensors are provided instead of these sensors in alternative embodiments.

The output signals $s_1$, $s_2$ from the sensors 22, 24 are supplied to a control unit 26, which is in the form of a digital signal processor (DSP) with the necessary additional circuitry. Two analog/digital converters 28, 30 convert the analog sensor output signals $s_1$, $s_2$ to digital measurement signals $p_1$, $p_2$ at a sampling frequency of approximately 1 kHz to 2 kHz.

The measurement signals $p_1$, $p_2$ are processed by a surge limit warning determination module 32 in a manner which will be described in more detail below. When a critical state is approached, the surge limit warning determination module 32 emits a surge limit warning W to an influencing module 34, which itself varies the operating parameters of the gas turbine 10 by means of a number of control signals $c_1$, $c_2$, $c_x$ such that the operating state of the gas turbine 10 is stabilized, and surging is thus avoided. In the present exemplary embodiment these are in particular a first control signal $c_1$, which activates the blow-off valves (not shown in FIG. 1), a second control signal $c_2$, which briefly reduces the fuel supply, and further control signals $c_x$ which, for example, adjust the thrust nozzle or the guide vanes. These measures are known per se.

In the present exemplary embodiment, the surge limit warning determination module 32 and the influencing module 34 are in the form of program modules of the digital signal processor (DSP) which forms the control unit 26. In alternative embodiments, these modules may also be implemented by analog or digital circuitry. Because the evaluation method according to the invention requires only relatively low computational power, the digital signal processor in the control unit 26 can carry out other tasks which, in particular, may be related to control of the gas turbine 10.

Figure 2:
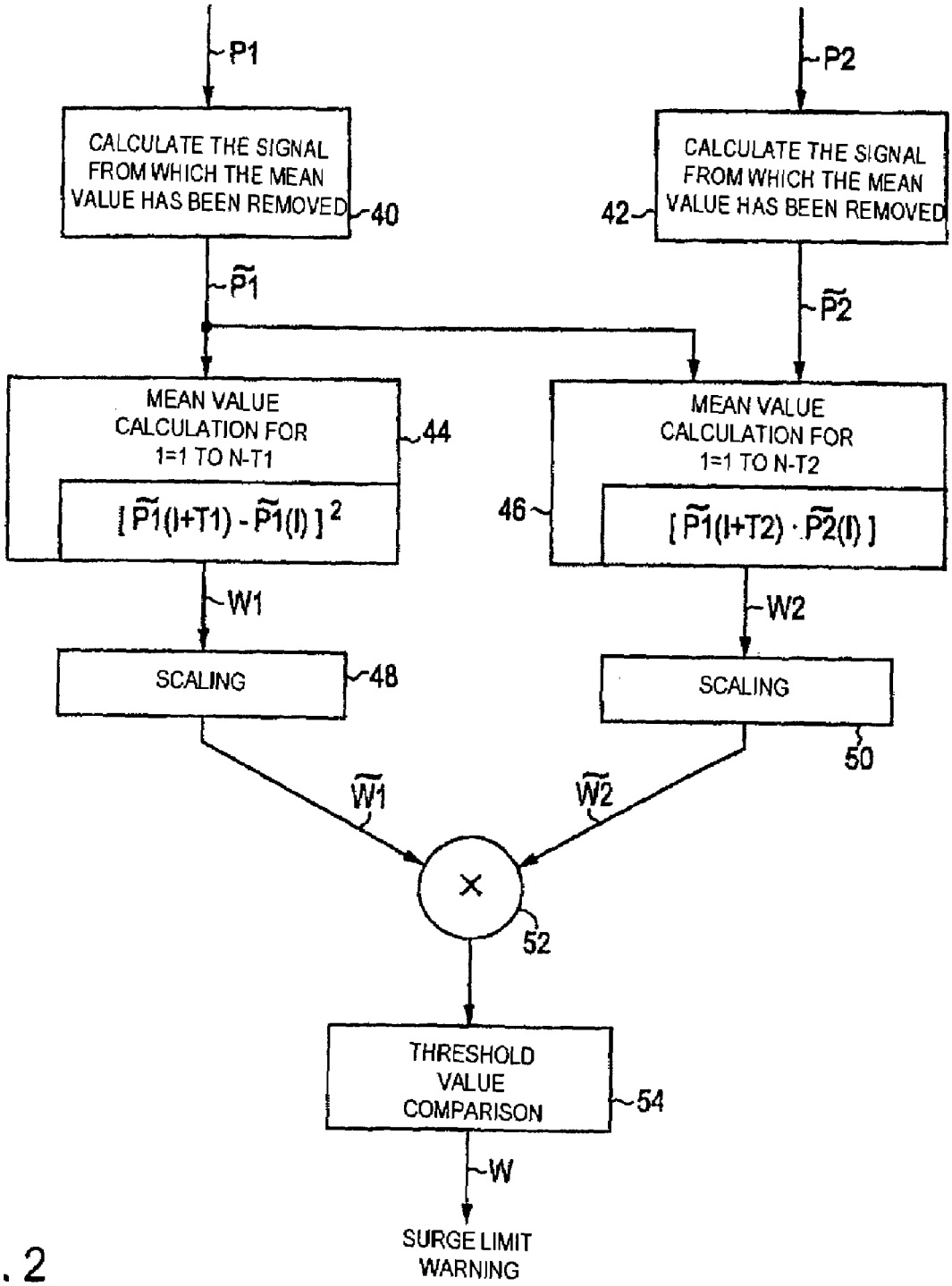
FIG. 2 shows a data flowchart of an evaluation method for the described exemplary embodiment.

The data flowchart shown in FIG. 2 illustrates the function of the surge limit warning determination module 32 in more detail. First of all, in the processing steps 40 and 42, a corresponding signal $\tilde{p}_1$ or $\tilde{p}_2$ is respectively formed from the two measurement signals $p_1$ and $p_2$. In the present exemplary embodiment, sliding mean values $\bar{p}_1$ or $\bar{p}_2$ of the measurement signals $p_1$ and $p_2$ are for this purpose calculated during a time window which is considerably longer (for example ten to one hundred times longer) than a fluctuation to be determined in the measurement signals $p_1$ and $p_2$. The mean value signals $\bar{p}_1$ and $\bar{p}_2$ are subtracted from the respective measurement signal $p_1$ or $p_2$. Overall, this therefore results in the measurement signals $\tilde{p}_1$ and $\tilde{p}_2$, from which the mean values have been removed, in accordance with the equations $\tilde{p}_1=p_1\ \bar{p}_1$ and $\tilde{p}_2=p_2\ \tilde{p}_2$, respectively.

Figure 3:
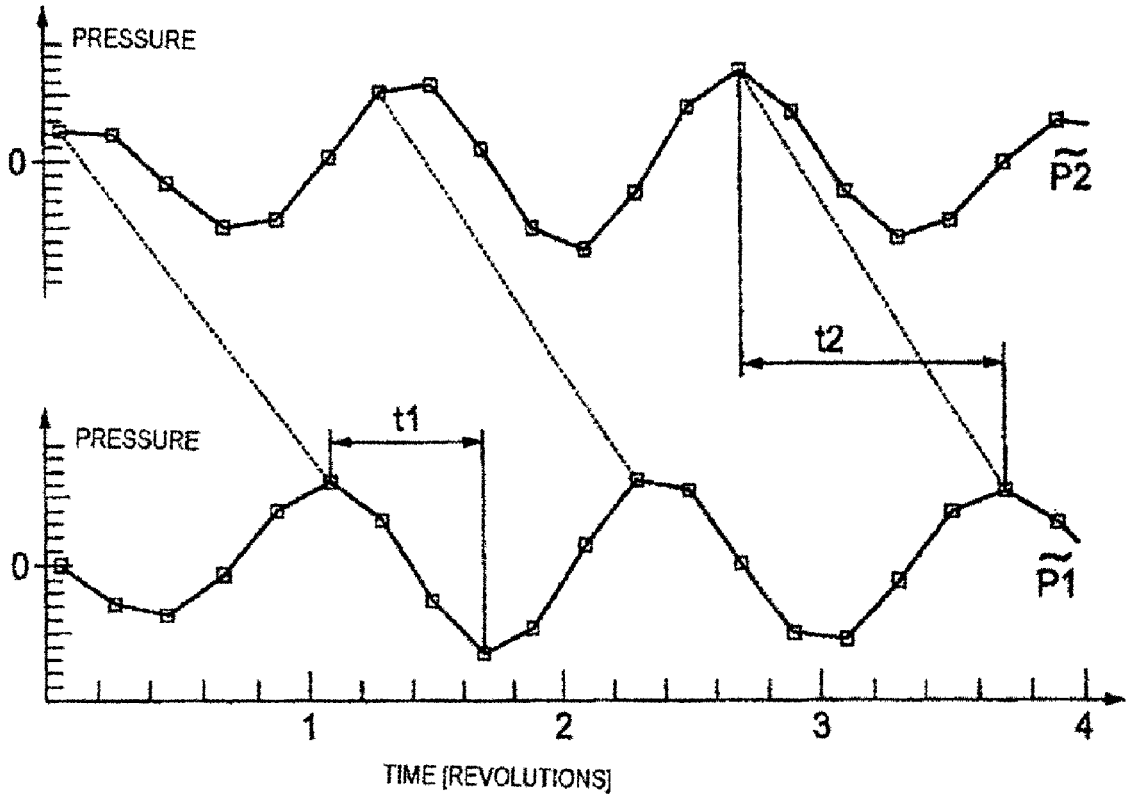
FIG. 3 shows an example of an illustration of the time profile of two measurement signals from which the mean values have been removed.

FIG. 3 shows an example of the profile of the two measurement signals $\tilde{p}_1$ and $\tilde{p}_2$ from which the mean values have been removed. These signals obviously have considerable periodic signal level changes (the maximum differences for the measurement signal $\tilde{p}_1$ occur at the time offset $t_1$, as shown in FIG. 3, of approximately 0.6 compressor revolutions). Furthermore, a considerable degree of correlation can be seen between the two measurement signals $\tilde{p}_1$ and $\tilde{p}_2$ when these are compared with one another with a time offset $t_2$ of approximately one compressor revolution. The three inclined, dotted lines in FIG. 3 show the correlation for three signal maxima.

Returning to FIG. 2, a periodicity value $W_1$ is determined in the calculation step 44, and indicates a measure for the occurrence of periodic signal level changes in the measurement signal $\tilde{p}_1$ from which the mean value has been removed. In alternative embodiments, the periodicity value $W_1$ could also be calculated from the measurement signal $p_1$ without the mean value having been removed from it or from one of the measurement signals $p_2$ or $\tilde{p}_1$, or two periodicity values could be determined for the measurement signals $\tilde{p}_1$ and $\tilde{p}_2$ (or for the measurement values $p_1$ and $p_2$).

In order to calculate the periodicity value $W_1$, the mean value of the square of the signal differences of in each case two measurement points of the measurement signal $\tilde{p}_1$ is calculated within a sliding time window of N measurement points, with the measurement points $\tilde{p}_1(i+t_1)$ and $\tilde{p}_1(i)$ which are in each case considered to be different by a predetermined time offset $t_1$. Using a formula notation, the calculation step 44 can be expressed as follows:

$$W_1 = \frac{1}{N - t_1} \cdot \sum_{i=1}^{N-t_1} [\tilde{p}_1(i + t_1) - \tilde{p}_1(i)]^2$$

For a given profile of the measurement signal $\tilde{p}_1$, the magnitude of the periodicity value $W_1$ depends inter alia on the choice of the time-offset value $t_1$. The periodicity value $W_1$ is a maximum when, as is shown in FIG. 3, the time offset $t_1$ is equivalent to approximately half the signal period. In different embodiments, the time offset $t_1$ is either fixed in advance (for a specific compressor type) or is dependent on operating parameters of the compressor (for example the instantaneous rotation speed).

The calculation step 46 in FIG. 2 relates to the determination of the correlation value $W_2$ from the measurement signals $\tilde{p}_1$ and $\tilde{p}_2$. The correlation value $W_2$ indicates how well the two measurement signals $\tilde{p}_1$ and $\tilde{p}_2$ are correlated with one another taking into account the second time offset $t_2$. This calculation allows the specific identification of revolving disturbances. In this case as well, the original measurement signals $p_1$ and $p_2$ may be used, in alternative embodiments, instead of the measurement signals $\tilde{p}_1$ and $\tilde{p}_2$ from which the mean values have been removed.

For the calculation of the correlation value $W_2$, the mean value of products which result from in each case one measurement point of the first measurement signal $\tilde{p}_1$ and one measurement point of the second measurement signal $\tilde{p}_2$ is calculated within the sliding time window with window width N. Then in each case two multiplied measurement points $\tilde{p}_1(i+t_2)$ and $\tilde{p}_2(i)$ differ by the time offset $t_2$. Using a formula notation, this calculation step 46 can be expressed as follows:

$$W_2 = \frac{1}{N - t_2} \cdot \sum_{i=1}^{N-t_2} [\tilde{p}_1(i + t_2) - \tilde{p}_2(i)]$$

In a similar way to the first time offset $t_1$, the second time offset $t_2$ may also optionally be fixed or variable. While, in the exemplary embodiment described here, the window width N is identical for the two calculation steps 44, 46, different (fixed or variable) window widths are provided in alternative embodiments.

In the next, optional steps 48 and 50, the periodicity value $W_1$ and the correlation value $W_2$ are scaled by reference to the inlet and/or outlet pressure of the compressor. The pressure values used for this purpose may either originate from further sensors or may be derived from the mean value signals $\bar{p}_1$ and $\bar{p}_2$ mentioned above. The scaling process results in a scaled periodicity value $\tilde{W}_1$ and a scaled correlation value $\tilde{W}_2$, which are multiplied by one another in the next step 52. The product $\tilde{W}_1 \cdot \tilde{W}_2$ is subject to threshold-value comparison in step 54. If the product $\tilde{W}_1 \cdot \tilde{W}_2$ exceeds a predetermined threshold value, then a surge limit warning W is initiated, and is supplied as an input signal to the influencing module 34 (FIG. 1).

The scaling steps 48, 50 are not absolutely essential; in fact, the values $W_1$ and $W_2$ may also be multiplied by one another in the step 52. The threshold value which is used in step 54 may be fixed or variable; in particular, it is also possible to obtain the same result as with the scaling of the values $W_1$ and $W_2$ by a corresponding change to the threshold value. In further alternative embodiments, a different function is calculated in step 52 rather than the product, for example the sum or the sum of the squares.

Overall, the described method allows safer compressor operation in a financially interesting operating area close to the surge limit (better efficiency), and improved disturbance tolerance of the compressor, particularly with regard to inlet disturbances.

In a comparable manner, blade damage to a rotor in the compressor or turbine area 12, 14 or 18, 20 of a turbomachine, such as the gas turbine 10 shown in FIG. 1, can be indicated as a warning (W) by means of the method described above, with further bad consequences being avoided, for example by shutting down this turbomachine which, for example, may be an aircraft engine, and subsequent repair or replacement of the damaged blade or blades.

The invention claimed is:

1. A method for determining a warning regarding a surge limit for a turbocompressor or of blade damage to a rotor in a turbomachine, the method comprising:

determining at least two measurement signals each of which corresponds respectively to an output signal of one of at least two sensors which are arranged offset with respect to one another in a circumferential direction of the turbocompressor or of the rotor, said sensors being temperature, pressure or flow velocity sensors;

calculating a periodicity value from at least one of the measurement signals, which periodicity value indicates a measure for occurrence of periodic signal level changes in the at least one measurement signal for a predetermined first time offset;

calculating a correlation value from the at least two measurement signals, which correlation value indicates a measure for similarity of the at least two measurement signals to one another for a predetermined second time offset; and determining the warning based on the periodicity value and the correlation value.

2. The method as claimed in claim 1, in which the warning is emitted when the product of the periodicity value and of the correlation value exceeds a predetermined threshold value.

3. The method as claimed in claim 1, in which at least one of the measurement signals is a measurement signal from which a mean value has been removed.

4. The method as claimed in claim 1, in which the periodicity value is calculated in a sliding time window with a predetermined window width from at least one of the measurement signals.

5. The method as claimed in claim 1, in which the periodicity value is calculated as a scaled average value of a square error between two measurement points, which are offset with respect to one another by the first time offset, of one of the measurement signals.

6. The method as claimed in claim 5, wherein an unscaled periodicity value is determined in accordance with one of the following formulae in order to calculate the periodicity value:

$$W_1 = \frac{1}{N - t_1} \cdot \sum_{i=1}^{N-t_1} [p_1(i + t_1) - p_1(i)]^2 \text{ or}$$

$$W_1 = \frac{1}{N - t_1} \cdot \sum_{i=1}^{N-t_1} [\tilde{p}_1(i + t_1) - \tilde{p}_1(i)]^2$$

where $p_1$ is the evaluated measurement signal without the mean value having been removed, and $\tilde{p}_1$ is the evaluated measurement signal from which the mean value has been removed, and N is the window width of the sliding evaluation time window, and $t_1$ is the first time offset.

7. The method as claimed in claim 1, wherein the correlation value is calculated in a sliding time window with a predetermined window width from the at least two measurement signals.

8. The method as claimed in claim 7, wherein an unscaled correlation value is determined in accordance with one of the following formulae in order to calculate the correlation value:

$$W_2 = \frac{1}{N - t_2} \cdot \sum_{i=1}^{N-t_2} [p_1(i + t_2) - p_2(i)] \text{ or}$$

$$W_2 = \frac{1}{N - t_2} \cdot \sum_{i=1}^{N-t_2} [\tilde{p}_1(i + t_2) - \tilde{p}_2(i)]$$

where $p_1$ is the first evaluated measurement signal without the mean value having been removed from it, and $\tilde{p}_1$ is the first evaluated measurement signal from which the mean value has been removed, and where $p_2$ is the second evaluated measurement signal without the mean value having been removed from it, and $\tilde{p}_2$ is the second evaluated measurement signal from which the mean value has been removed, and where N is the window width of the sliding evaluation time window and $t_2$ is the second time offset.

9. The method as claimed in claim 1, in which the correlation value is calculated as a scaled average value of a product of two measurement points, which are offset with respect to one another by the second time offset, of two different measurement signals.

10. The method of claim 1, wherein the turbomachine is a gas turbine, and said warning is a surge limit warning, the method further comprising:

changing of at least one operating parameter of the gas turbine in reaction to the surge limit warning, in order to avoid compressor surging.

11. The method of claim 1, wherein the determined warning indicates blade damage to a rotor of the turbomachine, the method further comprising:

recording and storing the warning for repair or replacement of the blade damage.

12. The method as claimed in claim 11, in which the extent of the damage is deduced from the nature of the warning.

13. A turbocompressor comprising:

a control unit; and at least two pressure, flow velocity or temperature sensors which are offset with respect to one another in a circumferential direction of the turbocompressor, wherein the control unit determines at least two measurement signals which correspond respectively to an output signal of one of at least two sensors, calculates a periodicity value from at least one of the measurement signals, which periodicity value indicates a measure for occurrence of periodic signal level changes in the at least one measurement signal for a predetermined first time offset, calculates a correlation value from the at least two measurement signals, which correlation value indicates a measure for similarity of the at least two measurement signals to one another for a predetermined second time offset and determines a surge limit warning based on the periodicity value and the correlation value.

14. The turbocompressor as claimed in claim 13, in which the control unit has a surge limit warning determination module and an influencing module, with the surge limit warning determination module determining the surge limit warning, and the influencing module influencing at least one operating parameter of the gas turbine in reaction to the surge limit warning by outputting at least one control signal, in order to avoid compressor surging.

15. A gas turbine comprising:

a turbocompressor comprising a control unit; and at least two pressure, flow velocity or temperature sensors which are offset with respect to one another in a circumferential direction of the turbocompressor, wherein the control unit determines at least two measurement signals which correspond respectively to an output signal of one of at least two sensors, calculates a periodicity value from at least one of the measurement signals, which periodicity value indicates a measure for occurrence of periodic signal level changes in the at least one measurement signal for a predetermined first time offset, calculates a correlation value from the at least two measurement signals, which correlation value indicates a measure for similarity of the at least two measurement signals to one another for a predetermined second time offset and determines a surge limit warning based on the periodicity value and the correlation value.

16. A method for determining a surge limit warning for a turbocompressor or a warning of blade damage to a rotor in a turbomachine, said method comprising:

receiving at least two measurement signals corresponding to output signals of at least two pressure, flow velocity or temperature sensors;

calculating a periodicity value from at least one of the measurement signals, the periodicity value indicating a measure for the occurrence of periodic signal level changes in the at least one measurement signal for a predetermined first time offset;

calculating a correlation value from the at least two measurement signals, the correlation value indicating a measure for the similarity of the at least two measurement signals to one another for a predetermined second time offset; and determining the warning from the periodicity and correlation values.

17. The method as claimed in claim 16, in which the warning is emitted when the product of the periodicity correlation values exceeds a predetermined threshold value.

18. The method as claimed in claim 16, wherein at least one of the measurement signals is a measurement signal from which a mean value has been removed.

19. The method as claimed in claim 16, wherein the periodicity value is calculated in a sliding time window with a predetermined window width from at least one of the measurement signals.

20. The method as claimed in claim 16, wherein the periodicity value is calculated as a scaled average value of a square error between two measurement points of the two measurement signals of one of the measurement signals, wherein the two measurement points are offset with respect to one another by the first time offset.

* * * * *